US005525942A

United States Patent [19]

Horii et al.

[11] Patent Number: 5,525,942

[45] Date of Patent: Jun. 11, 1996

[54] LC-TYPE DIELECTRIC FILTER AND DUPLEXER

[75] Inventors: Hiroyuki Horii; Kohichiro Shimizu; Toshikazu Yasuoka; Masao Iwata; Katsuhiko Gunji; Tomokazu Komazaki, all of Tokyo, Japan

[73] Assignee: OKI Electric Industry Co., Ltd., Tokyo, Japan

[21] Appl. No.: 279,169

[22] Filed: Jul. 22, 1994

[30] Foreign Application Priority Data

Aug. 9, 1993 [JP] Japan ..... 5-197364

[51] Int. Cl.[6] ..... H01P 1/213

[52] U.S. Cl. ..... 333/134; 333/204

[58] Field of Search ..... 333/202, 204, 333/219, 222, 100, 126, 129, 132, 134; 455/78, 80, 81, 82, 83; 370/24, 32, 38, 123

[56] References Cited

U.S. PATENT DOCUMENTS

| | | | |
|---|---|---|---|
| 4,431,977 | 2/1984 | Sokola et al. | 333/206 |
| 4,891,616 | 1/1990 | Renken et al. | 333/236 |
| 5,227,739 | 7/1993 | Mandai et al. | 331/969 |
| 5,237,296 | 8/1993 | Mandai et al. | 333/161 |
| 5,300,903 | 4/1994 | Okamura et al. | 333/204 |

FOREIGN PATENT DOCUMENTS

| | | |
|---|---|---|
| 0499643 | 8/1992 | European Pat. Off. . |
| 0519085 | 12/1992 | European Pat. Off. . |
| 62-164301 | 7/1987 | Japan . |
| 62-57122 | 11/1987 | Japan . |
| 3-173201 | 7/1991 | Japan . |
| 4-246901 | 9/1992 | Japan . |
| 327319 | 12/1993 | Japan . |
| 6105 | 1/1994 | Japan . |
| 85506 | 3/1994 | Japan . |

*Primary Examiner*—Benny Lee
*Assistant Examiner*—David Vu
*Attorney, Agent, or Firm*—Law Office of Steven M. Rabin

[57] ABSTRACT

An LC-type dielectric filter includes a plurality of substrate layers which are arranged in a stack and laminated to form a multi-layer substrate. Strip line resonators are provided on some of the substrate layers. The filter has a plurality of terminals, which are connected to resonators. The terminals are also capacitively or inductively coupled to each other. At least one grounding layer is included in the stack for electrically isolating the resonators. Coupling between the resonators can be obtained by forming a plurality of resonators close to one another on the same substrate layer. Further, a duplexer can be made from filters of this type. The duplexer may include a matching circuit and a power amplifier for RF transmission.

42 Claims, 8 Drawing Sheets

LC-TYPE DIELECTRIC FILTER AND DUPLEXER

CROSS-REFERENCE TO RELATED APPLICATION

This application claims the priority benefits of Japanese Patent Application No. 5-197364, filed Aug. 9, 1993, the entire disclosure of which is incorporated herein by reference.

BACKGROUND OF THE INVENTION

1. Field of the Invention

This invention relates to a band-pass filter. More specifically, it relates to a band-pass filter with a plurality of LC-type resonators and dielectric substrates. Such a filter may be used in, for example, a portable telephone or mobile telephone terminal. And this invention also relates to a duplexer using the LC-type dielectric filter.

2. Description of the Related Art

A dielectric filter may be used as a band-pass filter in mobile or portable telephone subscriber terminals. A typical conventional dielectric filter has a substantially rectangular dielectric block. A plurality of resonators extend from the top surface to the bottom surface of the dielectric block. Such a dielectric filter is disclosed in U.S. Pat. No. 4,431,997, "Ceramic Band Pass Filter" or Japanese Koukoku publication No. 62-57122, "Dielectric Filter".

This type of dielectric filter requires forming a plurality of resonant holes, and metalizing the inner surfaces of the resonant holes. Another type of band-pass filter is also known, and has a dielectric substrate, strip line resonators disposed on the substrate, and coupling circuits connected between the resonators. This type of filter is disclosed in Japanese Laid-Open Patent No. 62-164301, or No. 3-173201. To manufacture this type of filter, a process similar to that used to make printed-circuit boards can be employed. Accordingly, compared to the "rectangular type" dielectric filter, it is easier to manufacture this type of filter. Further, this type of filter can be manufactured to have a small size. However, because a plurality of resonators are on the same dielectric substrate, floating or stray capacitance occurs between the resonators, and thus, the stability of the coupling circuit is impaired.

SUMMARY OF THE INVENTION

Accordingly, it is an object of the present invention to provide a small-sized LC-type dielectric filter.

It is a further object of the present invention to provide an LC-type dielectric filter which can prevent the occurrence of floating or stray capacitance between the resonators.

It is another object of the present invention to provide a small-sized duplexer using the LC-type dielectric filter.

Therefore, briefly described, the present invention is an LC-type dielectric filter comprising a multi-layer substrate formed by a plurality of dielectric layers and at least one grounding layer, each of the dielectric layers having a resonator and the grounding layer being disposed between the plurality of dielectric layers; an input terminal and an output terminal, each disposed on the substrate; and a coupling circuit for coupling between each of the resonators.

DESCRIPTION OF THE PREFERRED EMBODIMENTS

Figure 1:
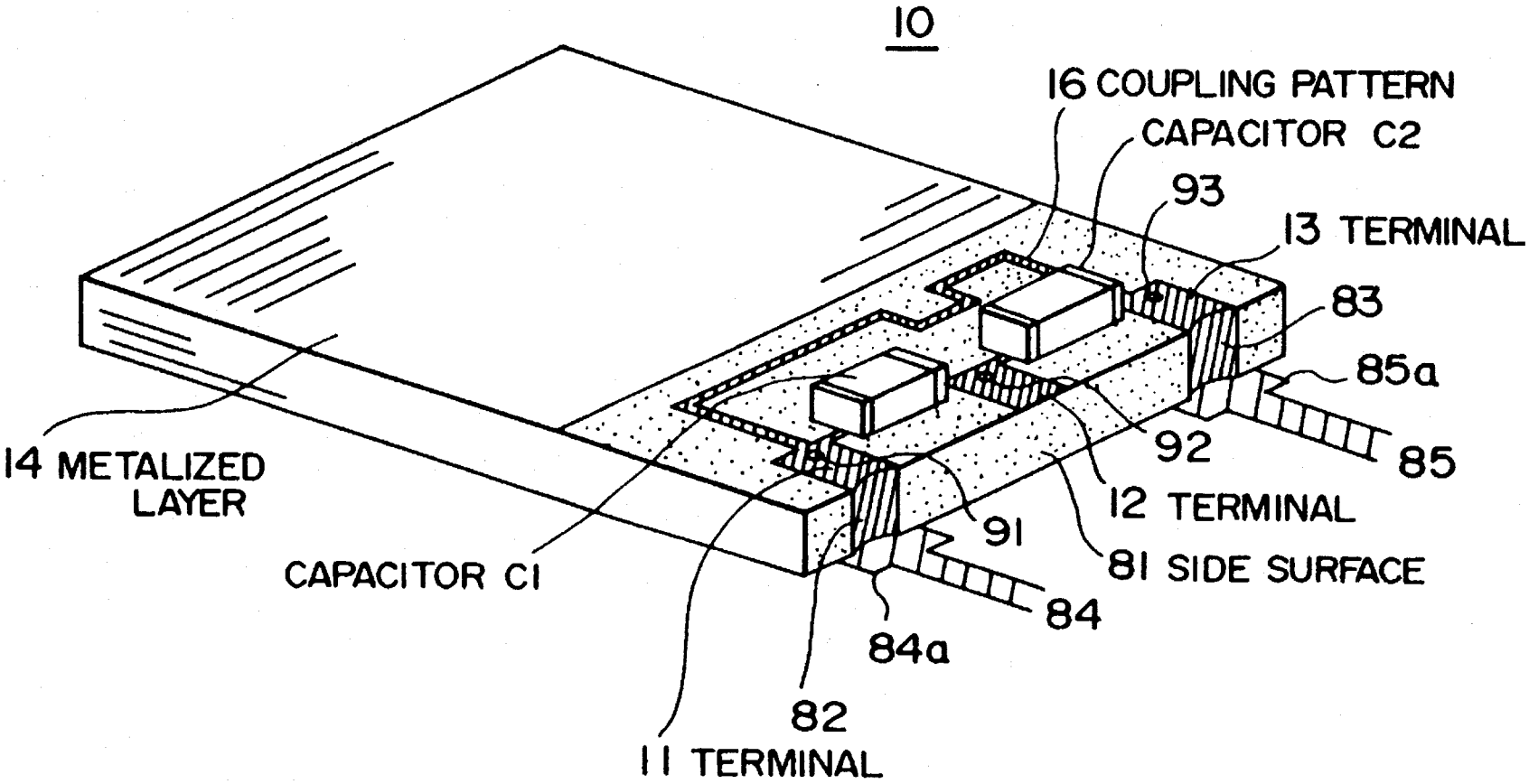
FIG. 1 is a perspective view of an LC-type dielectric filter in accordance with a first embodiment of this invention.

FIG. 1 shows a perspective view of a first embodiment of the LC-type dielectric filter of this invention. A filter 10 has a multi-layer substrate which is substantially rectangular in shape. The bottom surface, three side surfaces and a portion of the upper surface are metalized by metalized layer 14. The remaining portion of the upper surface and side surface 81 are bare dielectric material. Terminals 11, 12, and 13 are disposed on the bare portion of the upper surface. These terminals are formed by metalizing a conductive material on the bare portion. Each terminal has a through-hole. In FIG. 1, three through-holes 91, 92 and 93 are shown. The terminal 11 and the terminal 12 are connected with a capacitor C1. Thus, the terminals 11 and 12 are capacitively coupled. Similarly, the terminal 12 and the terminal 13 are connected with a capacitor C2 and thus the terminal 12 and the terminal 13 are capacitively coupled. The terminal 11 and the terminal 13 are coupled by a coupling pattern 16. On the side surface 81, there are two recesses 82 and 83. The recess 82 is located corresponding to the terminal 11, and the recess 83 is located corresponding to the terminal 13. The inner wall of each recess 82 and 83 is metalized. At the bottom surface of the filter 10, a portion of the metalized layer 14 is omitted so as to avoid a short circuit between the metalized layer 14 and the metalized layers on the recesses 82 and 83. This filter 10 is mounted on a circuit board (not shown). Printed circuit patterns 84 and 85 on the printed circuit board are connected to the terminals 11 and 13, respectively, at the recesses 82 and 83. A mounting pad 84a of the printed pattern 84 is soldered to the recess 82. Similarly, a mounting pad 85a of the printed pattern 85 is soldered to the recess 83.

Figure 2:
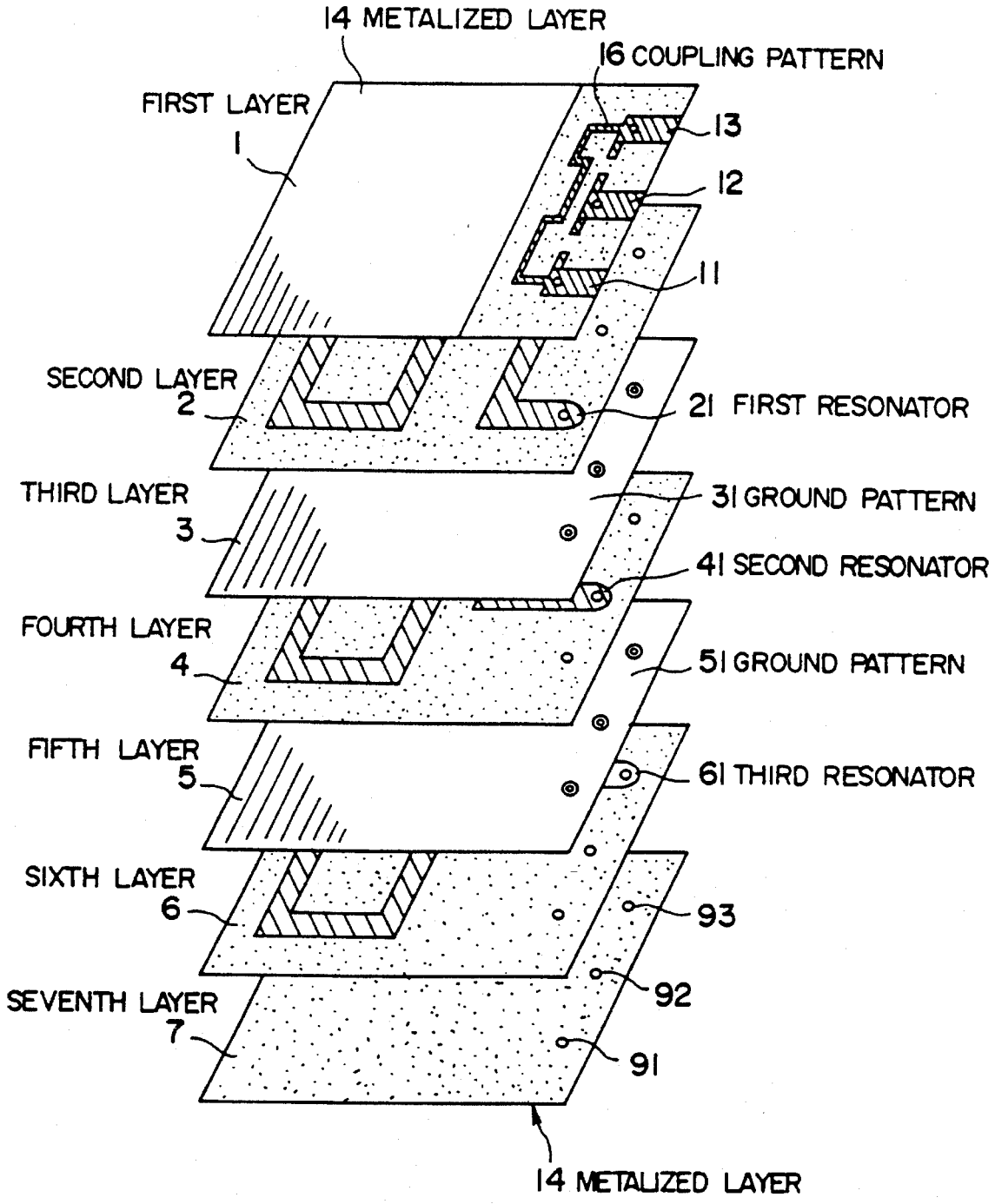
FIG. 2 shows every layer of a multi-layer substrate used in the first embodiment.

The layers of the multi-layer substrate of this embodiment are shown in FIG. 2. As shown in FIG. 2, the filter 10 has seven layers, namely, from a first layer 1 to a seventh layer 7. Each layer includes a dielectric substrate. As for layers through 1 to 6, all of the substrates have bare dielectric lower surfaces. The lower surface of the seventh layer corresponds to the bottom surface of the filter 10. The lower surface of the seventh layer 7 is substantially covered by the metalized layer 14. However, the metalized layer around the three through-holes is omitted to avoid short-circuiting. The upper surface of the seventh layer is completed bare dielectric material. The following explanation pertains to the upper surfaces of dielectric substrates through 1 to 6. The upper surface of the first layer 1 corresponds to the upper surface of the filter 10. As stated above, the terminals 11, 12 and 13, the metalized layer 14, and the coupling pattern 16 are on the upper surface. A first resonator 21 is on the upper surface of the second layer 2, and is formed by a conductive material on the second layer 2. The first resonator 21 is connected to the terminal 11 by the through-hole 91. The third layer 3 is a ground layer. Almost all of its upper surface, except for an area around the through-hole 91 to avoid short-circuiting, is covered by a ground pattern 31. On the upper surface of the fourth layer, there is a second resonator 41. The second resonator 41 is also formed by metalizing. The second resonator 41 is connected to the terminal 12 by the through-hole 92. The upper surface of the fifth layer 5, similar to the third layer 3, is covered by a ground pattern 51. On the upper surface of the sixth layer 6, there is a third resonator 61. The third resonator 61 is connected to the terminal 13 by the through-hole 93. The filter 10 is made by laminating these seven dielectric substrates. After laminating, the three side surfaces, except side surface 81, are metalized, and thus the filter 10 is obtained. Both of the ground patterns 31 and 51 are connected to the metalized layer 14. As a result, the upper surface, the bottom surface, and the three side surfaces are maintained at ground. Further, the ground patterns 31 and 51 are also maintained at ground.

To connect the metalized layer 14 to the ground patterns 31 and 51, for example, direct connecting or using a through-hole can be adopted. The through-holes 91, 92 and 93 connect the terminals to the resonators. Therefore, it is not necessary for the through-holes to penetrate all the layers, but to connect the resonator to the corresponding terminal.

As explained above, the filter 10 has terminals 11 to 13, and the resonators are connected to the respective terminals. The first resonator 21 is disposed between the metalized layer 14 and the ground pattern 31. The second resonator 41 is disposed between the ground pattern 31 and the ground pattern 51. The third resonator 61 is disposed between the ground pattern 51 and the metalized layer 14. Thus, all resonators are electrically insulated from each other.

The first resonator 21 is capacitively coupled to the metalized layer 14 via the dielectric material of the first layer 1. It is also capacitively coupled to the ground pattern 31 via the dielectric material of the second layer 2. Similar relationships can be seen with respect to the second resonator 41 and the third resonator 61. Therefore, each resonator functions as a kind of tri-plate type strip line filter.

Figure 3:
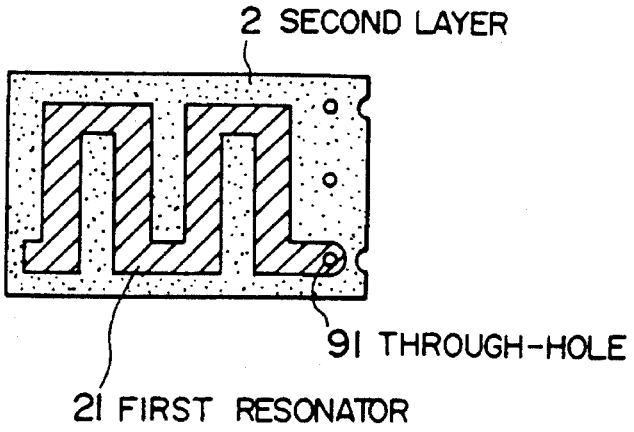
FIG. 3 shows an example of the layout pattern of the strip line for a resonator.

FIG. 3 shows an example of the layout pattern for a resonator. Here, the resonators are represented by the first resonator 21 on the second layer 2. The resonator 21 is formed as a metalized pattern which is metalized on the second layer 2. Those skilled in the art will appreciate that this is a distributed parameter type resonator. Although the pattern shown in FIG. 3 is zig-zag shaped, the shape of the resonator is not necessarily restricted to that shown in FIG. 3 as long as a relationship between the length of the resonator and the frequency is satisfied. For example, when making a half-wavelength resonator, the length is set at ½ of the wavelength of the resonant frequency, and the end opposite to the terminal is open. It will be understood that the resonator shown in FIG. 3 is a ½ wavelength resonator, since the opposite end is open.

When making a quarter-wavelength resonator, the length is set at ¼ of the wavelength of the resonant frequency, and the side opposite to the terminal is short-circuited. For the short-circuiting, the end opposite to the terminal should be connected to the metalized layer 14, directly or via a through-hole. Thus, both ½ wavelength resonators and ¼ wavelength resonators can be constituted.

A ground pattern can be metalized around each resonator to prevent the occurrence of floating or stray capacitance.

When applying an input signal to the terminal 11, this input signal is transferred to the first resonator 21 via the through-hole 91. The first resonator 21 resonates at a predetermined frequency. Next, the signal is transmitted to the adjacent terminal 12 via the capacitor C1. Thus, the second resonator 41 resonates. Finally, the signal is transmitted to the terminal 13 via the capacitor C2 and the third resonator 61 resonates. As a result, a frequency filter is achieved by coupling each resonator by a capacitor.

Figure 4:
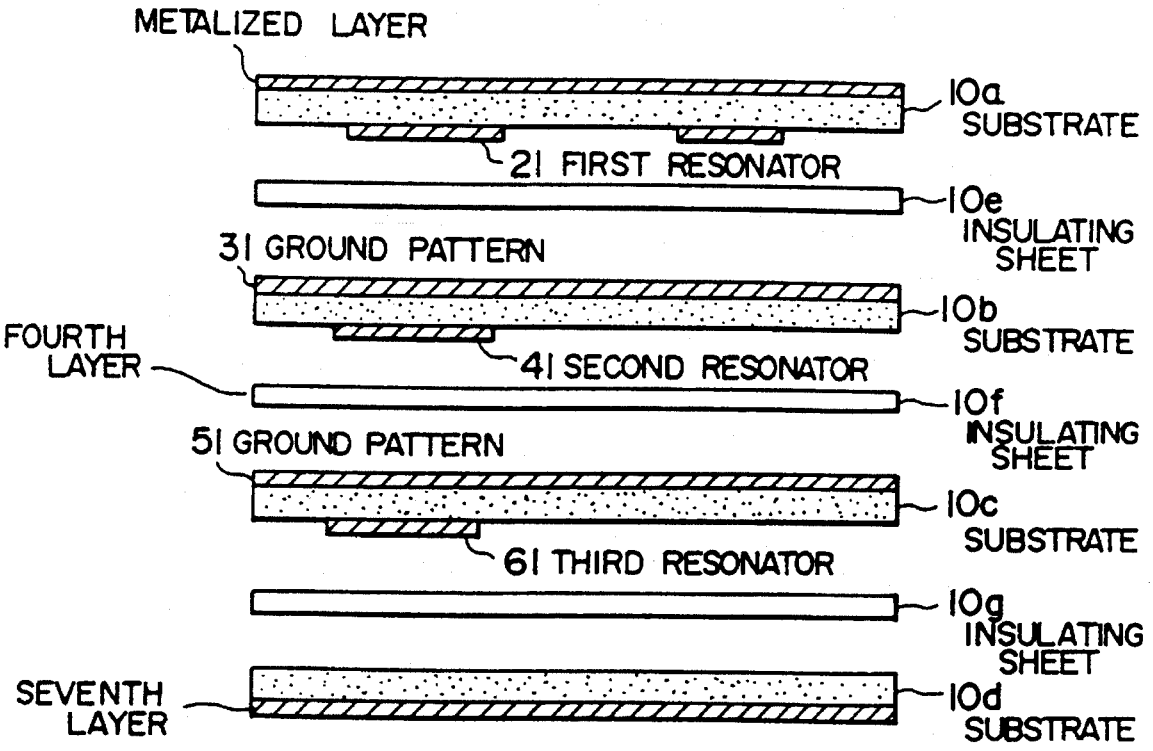
FIG. 4 shows another embodiment of the LC-type dielectric filter.

Another embodiment of the filter is shown in FIG. 4. As shown in FIG. 4, four dielectric substrates 10*a*, 10*b*, 10*c* and 10*d* constitute a multi-layer substrate. The first layer has a metalized upper surface. This metalized upper surface corresponds to the metalized layer 14 in FIG. 1. On the lower surface of the substrate 10*a*, a first resonator 21 is metalized.

A ground pattern 31 is formed on the upper surface of the substrate 10*b*. A second resonator 41 is formed on the lower surface of the substrate 10*b*. The third layer (the substrate 10*c*) has a ground pattern 51 on the upper surface, and has a third resonator 61 on the lower surface. The substrate 10*d* has a metalized pattern on the lower surface, which corresponds to the metalized layer 14. The upper surface of the substrate 10*d* is bare dielectric. The patterns of each layer are the same as previously indicated Insulating sheets 10*e*, 10*f* and 10*g* are disposed between the substrates to avoid short-circuiting. The insulating sheets contain epoxy or polyimide mainly and insulate each layer. In this embodiment, however, insulating sheet 10*g* is not necessary from the aspect of insulation. Thus a filter is obtained by laminating these dielectric substrates and insulating sheets. This embodiment can reduce the number of substrates.

In this embodiment, each resonator also functions as a tri-plate type strip line filter. For example, the first resonator 21 is coupled to the metalized layer 14 via the dielectric substrate 10*a*. The first resonator 21 is also coupled to the ground pattern 31 via the dielectric substrate 10*b*. The other resonators are similar.

Figure 5:
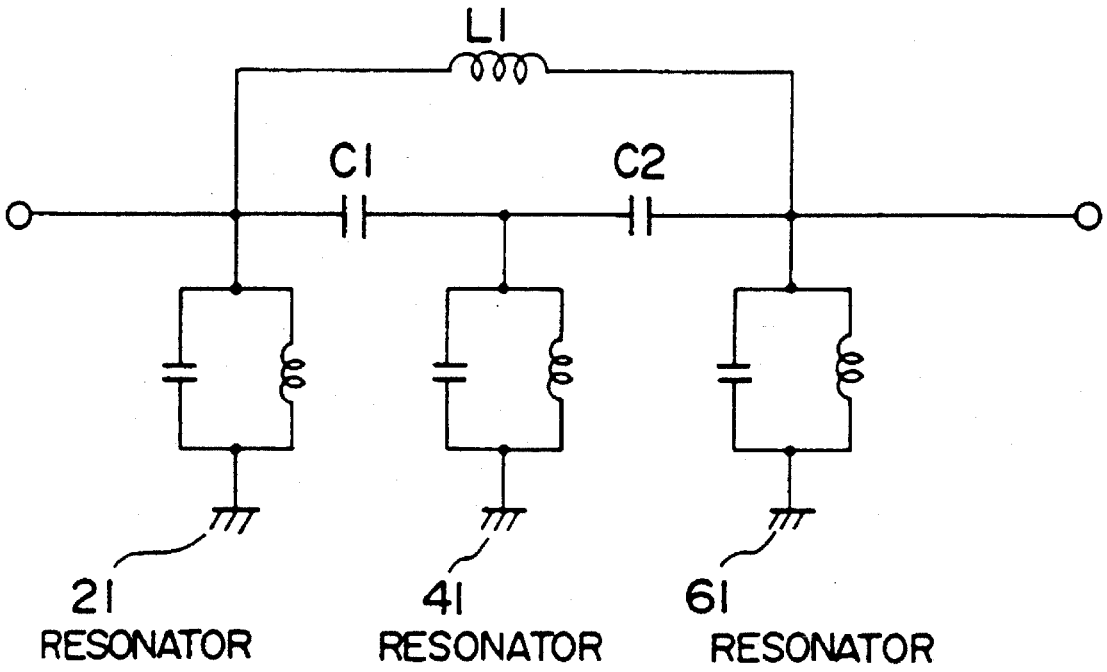
FIG. 5 is a schematic diagram for the equivalent circuit of the dielectric filter shown in FIG. 1.

FIG. 5 shows the equivalent circuit for such an LC-type dielectric filter. Each resonator functions as a distributed constant type resonator. The resonators are coupled to each other by the capacitors C 1 and C2. Further, the resonator 21 and the resonator 23 are directly coupled by an inductance L1 which is provided by the coupling pattern 16.

Figure 6A:
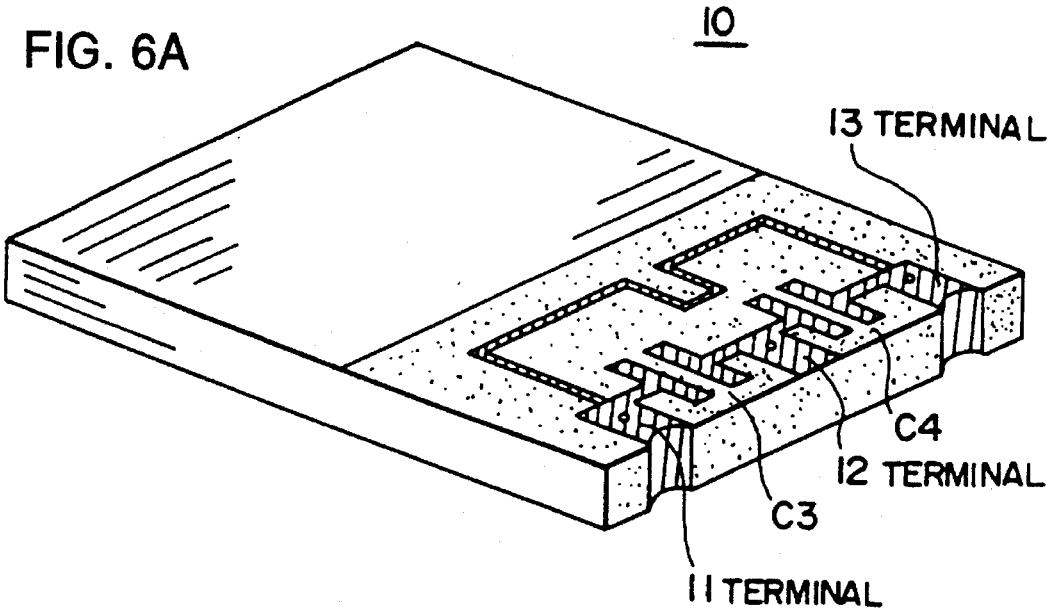
FIGS. 6A and 6B show other examples of the coupling circuit.
Figure 6B:
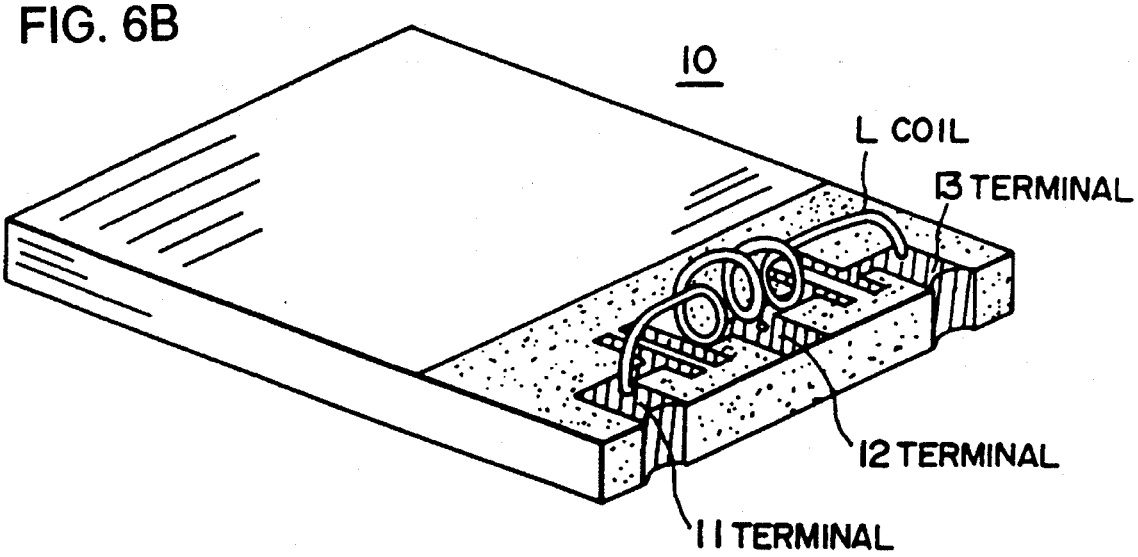

FIGS. 6A and 6B show other examples of the coupling circuit. FIG. 6A shows a capacitor coupling. Capacitor C3 and C4 are achieved by metalized patterns on the remaining (bare dielectric) portion of the upper surface of the filter 10. FIG. 6B shows an inductance coupling. Namely, the terminal 11 and the terminal 13 are connected directly by coil L. Both configurations have the equivalent circuit shown in FIG. 5.

As explained above, a resonator is formed on a dielectric substrate, and then a multi-layered substrate is formed by arranging a plurality of such dielectric substrates in a stack and laminating them. Electrical interference between the resonators can be avoided, since each resonator is electrically isolated by the ground pattern.

Figure 7:
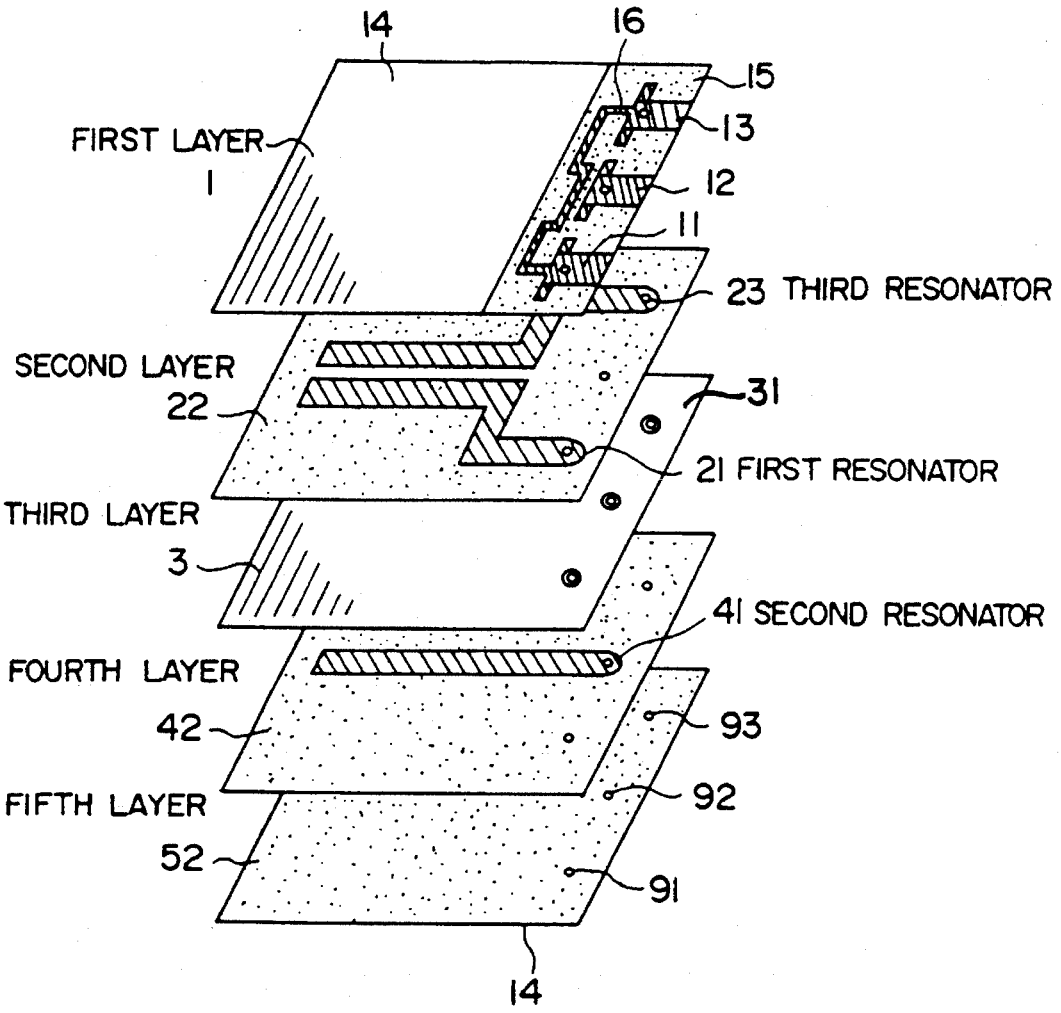
FIG. 7 shows another embodiment of LC-type dielectric filter.

FIG. 7 shows another embodiment of this invention. In this embodiment, floating or stray capacitance between the resonators is intentionally utilized by forming a plurality of resonators on the same substrate. A specific configuration will be explained hereinbelow. The same reference numerals are used for the same elements.

As shown in FIG. 7, the filter 10 has five layers, namely, from a first layer 1 to a fifth layer 52. Each layer includes a dielectric substrate. As for the first to the fourth layers, all of the substrates have bare dielectric lower surfaces. The lower surface of the fifth layer corresponds to the bottom surface of the filter 10 and is substantially covered by the metalized layer 14. However, the metalized layer around the three through-holes is omitted to avoid short-circuiting. The upper surface of the fifth layer is completely bare dielectric material. The following explanation pertains to the upper surfaces of the dielectric substrates of the first layer to the fourth layer.

The upper surface of the first layer 1 corresponds to the upper surface of the filter 10. As stated above, the terminals 11, 12 and 13, the metalized layer 14, and the coupling pattern 16 are on the upper surface. A first resonator 21, formed by conductive material, is provided on the upper surface of the second layer 22. The first resonator 21 is connected to the terminal 11 by the through-hole 91. The third layer 3 is a ground layer. Almost all of its upper surface, except for an area around the through-hole 91 to avoid short circuiting, is covered by a ground pattern 31.

On the upper surface of the fourth layer 42, there is a second resonator 41. The second resonator 41 is also formed by metalizing. The second resonator 41 is connected to the terminal 12 by the through-hole 92. A third resonator 23 is provided on the second layer 22. The third resonator 23 is connected to the terminal 13 by the through-hole 93. The filter 10 is obtained by laminating the layers. The resonators 21 and 23 are disposed closely. Thus, a capacitive coupling occurs between these resonators.

Figure 8:
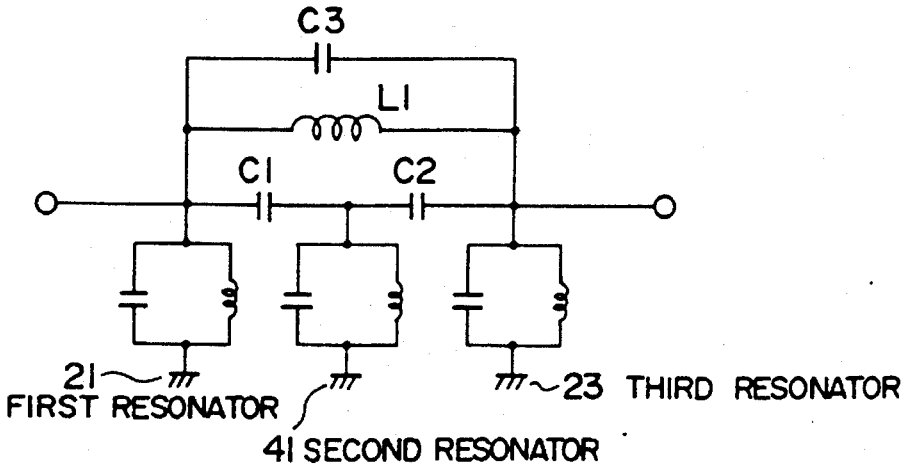
FIG. 8 is a schematic diagram for the equivalent circuit of the filter shown in Fig. 7.

FIG. 8 shows the equivalent circuit for this embodiment. In the figure, the first resonator 21 and the second resonator 41 are coupled by the capacitor C1, and the second resonator 41 and the third resonator 23 are coupled by the capacitor C2. Resonators 21 and 23 are coupled by an inductance L1, which is provided by the metalized coupling pattern 16. In addition to the coupling by L1, further coupling by C3 occurs between the first resonator 21 and the third resonator 23.

As explained above, a floating capacitance is intentionally utilized in this embodiment. Such a configuration requires consideration about the floating capacitance at the time of design, but sharper characteristics can be obtained.

Figure 9:
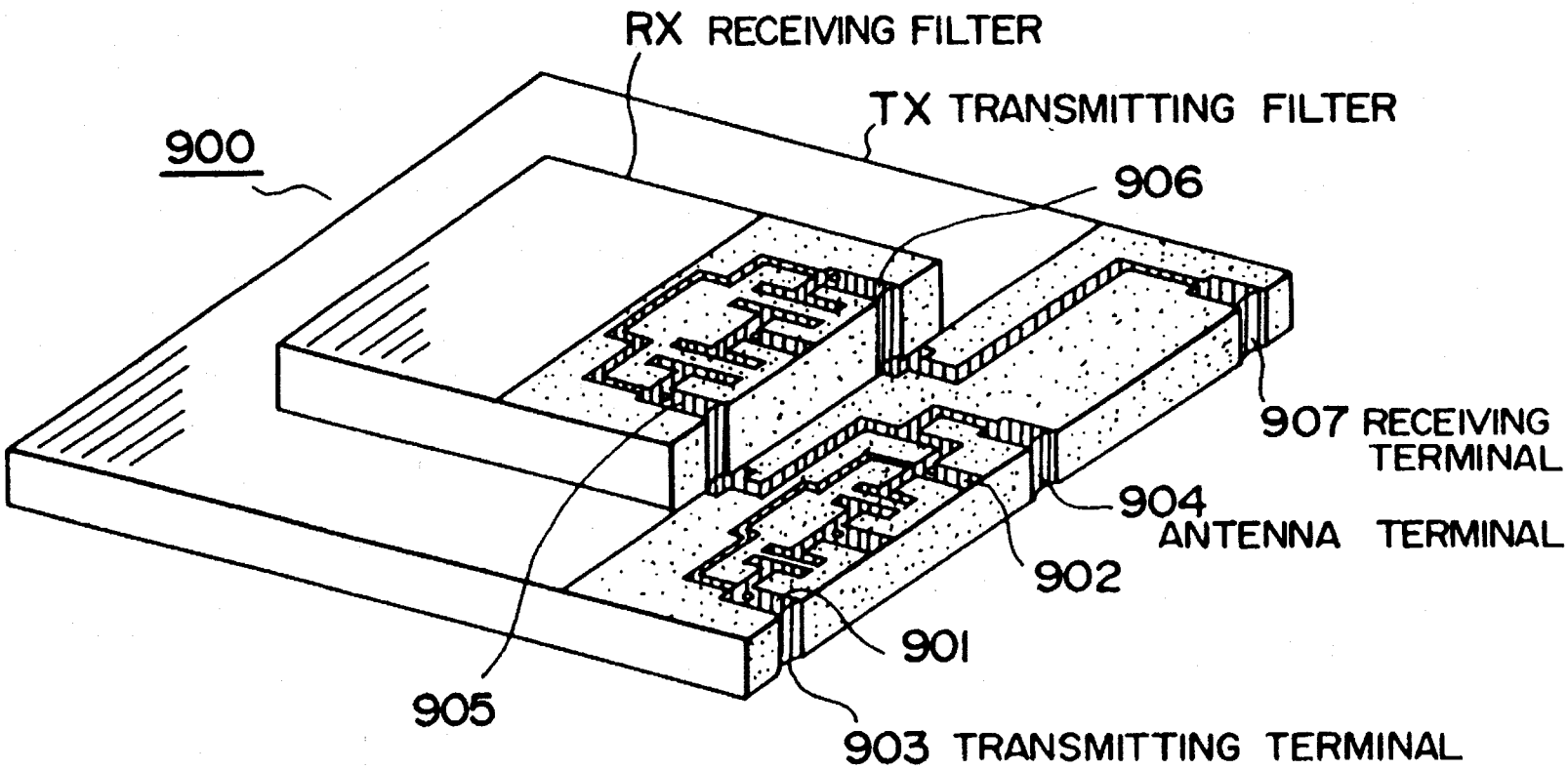
FIG. 9 shows a further embodiment of this invention.

A further embodiment of this invention is shown in FIG. 9, which shows a duplexer 900. The duplexer 900 has a transmitting filter TX and a receiving filter RX on the transmitting filter TX. The configuration of each filter is substantially the same as that of the filter shown in FIG. 1 or FIG. 2.

The transmitting filter TX has an input terminal 901 and an output terminal 902. The input terminal 901 is connected to a transmitting circuit (not shown) via a transmitting terminal 903, and the output terminal 902 is connected to an antenna (not shown) via an antenna terminal 904. The receiving filter has an input terminal 905 and an output terminal 906. The input terminal 905 is connected to the antenna via the antenna terminal 904. The output terminal 906 is connected to a receiving circuit (not shown) via a receiving terminal 907.

For the transmitting terminal 903, antenna terminal 904, and receiving terminal 907, appropriate recesses are formed on a side surface of the transmitting filter TX. These terminals are connected to metalized patterns on a printed circuit board (not shown) on which the duplexer 900 is mounted.

A signal from a base station is received at the antenna, and then fed to the input terminal 905 of the receiving filter RX. Signals within a predetermined frequency range pass the receiving filter RX and are then applied to the receiving circuit via the output terminal 907. On the other hand, a signal generated by a transmitting circuit is applied to the input terminal 901 of the transmitting filter TX. This signal is filtered at the transmitting filter TX and then fed to the antenna, via the output terminal 902 and the antenna terminal 904.

The duplexer 900 has a separating circuit. The separating circuit comprises a metalized pattern between the antenna terminal 904 and the input terminal 905, and a metalized pattern between the antenna terminal 904 and the output terminal 902.

The separating circuit allows the received signal to go through from the antenna terminal 904 to the input terminal 905, and prevents it from going through from the antenna terminal to the output terminal 902. The separating circuit also allows the transmit signal to go through from the output terminal 902 to the antenna terminal 904, and prevents it from going through from the output terminal 902 to the input terminal 905.

To obtain such a separating circuit, the distance between each terminal is determined appropriately. Since many references have disclosed a method for obtaining a separating circuit by metalizing, no further explanation about the separating circuit is presented hereinafter.

Such an embodiment can reduce the number of parts, or the size of the duplexer. Although the transmitting filter TX and the receiving filter RX are separate in this embodiment, a duplexer which has both transmitting and receiving filters in the same multi-layer substrate can be made. Further, either the transmitting filter TX or the receiving filter RX can be replaced by another type of frequency filter, for example, a surface acoustic wave (SAW) filter.

Figure 10:
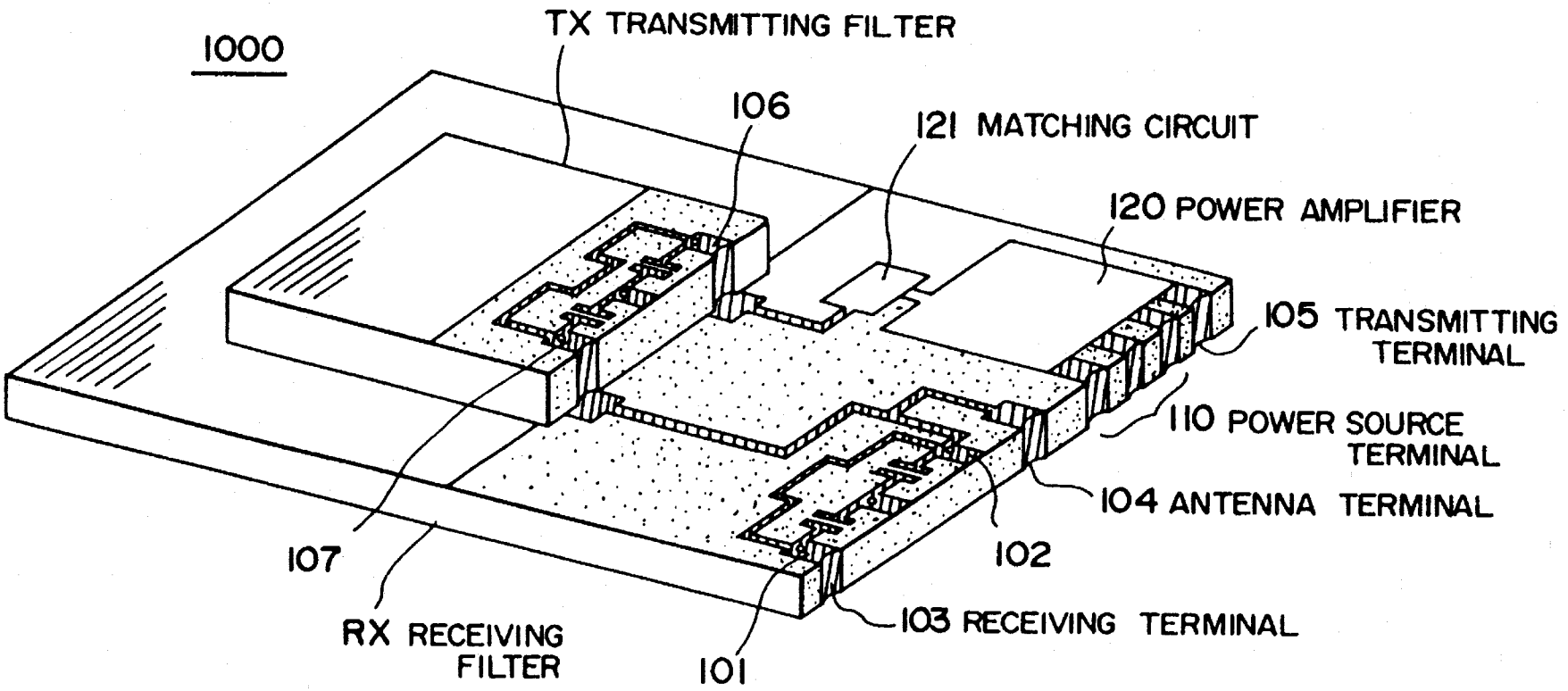
FIG. 10 shows yet another embodiment of this invention.

The next embodiment of this invention is shown in FIG. 10. The duplexer shown in FIG. 10 comprises a power amplifier 120 and a matching circuit 121 in addition to the transmitting filter and the receiving filter. The basic construction of this embodiment is substantially the same as that of the embodiment shown in FIG. 9, and the power amplifier and the matching circuit will be especially explained hereinafter.

The duplexer 1000 comprises a receiving filter RX. The receiving filter RX comprises an output terminal 101 and an input terminal 102. The duplexer 1000 also comprises a transmitting filter TX on the receiving filter RX. The transmitting filter TX comprises an input terminal 106 and an output terminal 107. The duplexer 1000 further comprises a receiving terminal 103, an antenna terminal 104, a transmitting terminal 105, and power source terminals 110 at the side of the receiving filter RX. The receiving terminal 103 is connected to the input terminal 101. The antenna terminal 104 is connected to the input terminal 102 and the output terminal 107. The transmitting terminal 105 is connected to the power amplifier 120. The power source terminals 110 are also connected to the power amplifier 120. Similar to the embodiment shown in FIG. 9, an appropriate separating circuit is employed. The power amplifier 120 is disposed on the upper surface of the receiving filter RX. The power amplifier 120 amplifies a transmit signal applied by the transmitting circuit, and the amplified transmit signal is fed to the matching circuit 121. Power for the power amplifier 120 is applied via the power source terminals 110.

The matching circuit 121 matches impedance between the transmitting circuit and the antenna. For example, the antenna impedance from the transmitting circuit is typically set at 50 OHMS in portable telephone subscriber terminals.

The power amplifier 120 and the matching circuit 121 can be constructed directly on the upper surface of the receiving filter RX, or they can be constructed as a separate module.

What is claimed is:

1. An LC-type dielectric filter, comprising:

a multi-layer substrate which includes an input substrate having an input resonator, an output substrate having an output resonator, at least one intermediate substrate having at least one intermediate resonator, and at least one grounding layer disposed between the substrates;

an input means coupled to the input resonator;

an output means coupled to the output resonator; and coupling means for coupling the at least one intermediate resonator between the input resonator and the output resonator, the coupling means including a first reactance element which is connected to the input resonator but not the output resonator and a second reactance element which is connected to the output resonator but not the input resonator.

2. An LC-type dielectric filter according to claim 1, wherein the first and second reactance elements are capacitors.

3. An LC-type dielectric filter according to claim 1, further comprising additional coupling means for coupling non-adjacent resonators, the additional coupling means including at least one additional reactance element.

4. An LC-type dielectric filter according to claim 1, wherein the input means comprises an input terminal and a through-hole which couples the input terminal and the input resonator.

5. An LC-type dielectric filter according to claim 1, wherein the output means comprises an output terminal and a through-hole which couples the output terminal and the output resonator.

6. An LC-type dielectric filter according to claim 1, wherein the resonators are strip-line resonators which are formed on the substrates.

7. The LC-type dielectric filter of claim 1, wherein the at least one grounding layer comprises a plurality of grounding layers which are disposed parallel to one another at spaced-apart positions in the multi-layer substrate.

8. The LC-type dielectric filter of claim 1, wherein the multi-layer substrate has a top surface, a bottom surface, and a side surface connecting the top and bottom surfaces, and further comprising a metalized layer which covers a substantial portion of the top surface, a substantial portion of the side surface, and a substantial portion of the bottom surface, the at least one grounding layer being electrically connected to the metalized layer at the side surface.

9. The LC-type dielectric filter of claim 8, wherein the multi-layer substrate additionally has a plurality of further side surfaces connecting the top and bottom surfaces, and wherein the metalized layer additionally covers a substantial portion of at least two of the further side surfaces.

10. The LC-type dielectric filter of claim 8, wherein the top surface additionally has an uncovered portion which is not covered by the metalized layer, and wherein the first and second reactive elements comprise conductive patterns on the uncovered portion of the top surface.

11. An LC-type dielectric filter, comprising:

a multi-layer substrate which has a plurality of resonators and which includes a first substrate having top and bottom surfaces and having a first one of the plurality of resonators on its bottom surface, a second substrate having top and bottom surfaces and having a second one of the plurality of resonators on its bottom surface, a grounding layer being affixed to the top surface of the second substrate, an insulating sheet between the grounding layer and the first resonator, a third substrate having top and bottom surfaces and having a third one of the plurality of resonators on its bottom surface, another ground layer being affixed to the top surface of the third substrate, and another insulating sheet between the another grounding layer and the second resonator;

an input means coupled to one of the resonators in the multi-layer substrate;

an output means coupled to another of the resonators in the multi-layer substrate, coupling means for coupling the resonators in the multi-layer substrate to one another.

12. An LC-type dielectric filter according to claim 11, wherein the coupling means comprises reactance elements disposed between adjacent resonators.

13. An LC-type dielectric filter according to claim 11, wherein the coupling means includes first coupler means for coupling adjacent resonators, and second coupler means for coupling non-adjacent resonators.

14. An LC-type dielectric filter according to claim 11, wherein the input means includes an input terminal and a through-hole which couples the input terminal and said one of the resonators in the multi-layer substrate.

15. An LC-type dielectric filter according to claim 11, wherein the output means comprises an output terminal and a through-hole which couples the output terminal and said another of the resonators in the multi-layer substrate.

16. An LC-type dielectric filter according to claim 11, wherein the resonators are strip-line resonators which are formed on the substrates.

17. The LC-type dielectric filter of claim 9, wherein the multi-layer substrate has a top surface, a bottom surface, and a side surface connecting the top and bottom surfaces of the multi-layer substrate, the top surface of the first substrate of the multi-layer substrate serving as the top surface of the multi-layer substrate itself, and further comprising a metalized layer which covers a substantial portion of the top surface of the multi-layer substrate, a,substantial portion of the side surface of the multi-layer substrate, and a substantial portion of the bottom surface of the multi-layer substrate, the grounding layer and the another grounding layer being electrically connected to the metalized layer at the side surface of the multi-layer substrate.

18. The LC-type dielectric filter of claim 17, wherein the multi-layer substrate additionally has a plurality of further side surfaces connecting the top and bottom surfaces of the multi-layer substrate, and wherein the metalized layer additionally covers a substantial portion of at least two of the further side surfaces.

19. The LC-type dielectric filter of claim 17, wherein the top surface of the multi-layer substrate additionally has an uncovered portion which is not covered by the metalized layer, and wherein the coupling means comprises conductive patterns forming a plurality of printed circuit impedance elements on the uncovered portion of the top surface of the multi-layer substrate.

20. An LC-type dielectric filter having a multi-layer substrate, comprising:

a first resonator disposed on a first layer;

a second resonator disposed on a second layer;

at least one further resonator; and at least one grounding layer disposed between the resonators;

wherein at least one of the resonators is disposed on the same layer which has another resonator thereon, whereby an overcoupling between these resonators is obtained.

21. The LC-type dielectric filter of claim 20, wherein the multi-layer substrate has a top surface, a bottom surface, and a side surface connecting the top and bottom surfaces, and further comprising a metalized layer which covers a substantial portion of the top surface, a substantial portion of the side surface, and a substantial portion of the bottom surface, the at least one grounding layer being electrically connected to the metalized layer at the side surface.

22. The LC-type dielectric filter of claim 21, wherein the multi-layer substrate additionally has a plurality of further side surfaces connecting the top and bottom surfaces, and wherein the metalized layer additionally covers a substantial portion of at least two of the further side surfaces.

23. The LC-type dielectric filter of claim 21, wherein the top surface additionally has an uncovered portion which is not covered by the metalized layer, and further comprising coupling means for providing coupling between the resonators in the multi-layer substrate, the coupling means including conductive patterns forming a plurality of printed circuit impedance elements on the uncovered portion of the top surface.

24. An LC-type dielectric filter having a multi-layer substrate, comprising:

an input resonator disposed on a first layer;

an intermediate resonator disposed on a second layer;

an output resonator disposed on the first layer, the input resonator and the output resonator being positioned closely adjacent one another whereby an overcoupling between these resonators is obtained; and a grounding layer between the first and second layers.

25. A duplexer having a receiving terminal, an antenna terminal, and a transmitting terminal, comprising:

a transmitting filter having an input terminal and an output terminal;

means for coupling the input terminal of the transmitting filter and the transmitting terminal of the duplexer;

means for coupling the output terminal of the transmitting filter and the antenna terminal of the duplexer;

a receiving filter having an input terminal and an output terminal, means for coupling the input terminal of the receiving filter and the antenna terminal of the duplexer; and means for coupling the output terminal of the receiving filter and the receiving terminal of the duplexer;

wherein at least one of the filters is an LC-type dielectric filter which comprises a multi-layer substrate which includes an input substrate having a distributed parameter input resonator, an output substrate having a distributed parameter output resonator, at least one intermediate substrate having at least one distributed parameter intermediate resonator, and at least one grounding layer disposed between the substrates, an input means coupling the input resonator to the input terminal of the dielectric filter, an output means coupling the output resonator to the output terminal of the dielectric filter, and coupling means for coupling the at least one intermediate resonator between the input resonator an the output resonator, the coupling means including a first reactance element which is connected to the input resonator but not the output resonator and a second reactance element which is connected to the output resonator but not the input resonator.

26. The duplexer of claim 25, wherein the at least one grounding layer comprises a plurality of grounding layers which are disposed parallel to one another at spaced-apart positions in the multi-layer substrate.

27. The duplexer of claim 25, wherein the multi-layer substrate has a top surface, a bottom surface, and a side surface connecting the top and bottom surfaces, and further comprising a metalized layer which covers a substantial portion of the top surface, a substantial portion of the side surface, and a substantial portion of the bottom surface, the at least one grounding layer being electrically connected to the metalized layer at the side surface.

28. The duplexer of claim 27, wherein the multi-layer substrate additionally has a plurality of further side surfaces connecting the top and bottom surfaces, and wherein the metalized layer additionally covers a substantial portion of at least two of the further side surfaces.

29. The LC-type dielectric filter of claim 27, wherein the top surface additionally has an uncovered portion which is not covered by the metalized layer, and wherein the first and second reactive elements comprise conductive patterns on the uncovered portion of the top surface.

30. A duplexer having a receiving terminal, an antenna terminal, and a transmitting terminal, comprising:

a transmitting filter having an input terminal and an output terminal;

means for coupling the input terminal of the transmitting filter and the transmitting terminal of the duplexer;

means for coupling the output terminal of the transmitting filter and the antenna terminal of the duplexer;

a receiving filter having an input terminal and an output terminal;

means for coupling the input terminal of the receiving filter and the antenna terminal of the duplexer; and means for coupling the output terminal of the receiving filter and the receiving terminal of the duplexer;

wherein at least one of the filters is an LC-type dielectric filter which comprises a multi-layer substrate which has a plurality of distributed parameter resonators and which includes a first substrate having top and bottom surfaces and having a first one of the plurality of resonators on its bottom surface, a second substrate having top and bottom surfaces and having a second one of the plurality of resonators on its bottom surface, a grounding layer being affixed to the top surface of the second resonator, an insulating sheet between the grounding layer and the first resonator, a third substrate having top and bottom surfaces and having a third resonator on its bottom surface, another grounding layer being affixed to the top surface of the third substrate, and another insulating sheet between the another grounding layer and the second resonator;

an input means coupling one of the resonators in the multi-layer substrate to the input terminal of the dielectric filter;

an output means coupling another of the resonators in the multi-layer substrate to the output terminal of the dielectric filter; and coupling means for coupling the resonators in the multi-layer substrate to one another.

31. The duplexer of claim 30, wherein the multi-layer substrate has a top surface, a bottom surface, and a side surface connecting the top and bottom surfaces of the multi-layer substrate, the top surface of the first substrate of the multi-layer substrate serving as the top surface of the multi-layer substrate itself, and further comprising a metalized layer which covers a substantial portion of the top surface of the multi-layer substrate, a substantial portion of the side surface of the multi-layer substrate, and a substantial portion of the bottom surface of the multi-layer substrate, the grounding layer and the another grounding layer being electrically connected to the metalized layer at the side surface of the multi-layer substrate.

32. The duplexer of claim 31, wherein the multi-layer substrate additionally has a plurality of further side surfaces connecting the top and bottom surfaces of the multi-layer substrate, and wherein the metalized layer additionally covers a substantial portion of at least two of the further side surfaces.

33. The LC-type dielectric filter of claim 31, wherein the top surface of the multi-layer substrate additionally has an uncovered portion which is not covered by the metalized layer, and wherein the coupling means comprises conductive patterns forming a plurality of printed circuit impedance elements on the uncovered portion of the top surface of the multi-layer substrate.

34. A duplexer having a receiving terminal, an antenna terminal, and a transmitting terminals, comprising:

a transmitting filter having an input and an output terminal;

means for coupling the input terminal of the transmitting filter and the transmitting terminal of the duplexer;

means for coupling the output terminal of the transmitting filter and the antenna terminal of the duplexer;

a receiving filter having an input terminal and an output terminal;

means for coupling the input terminal of the receiving filter and the antenna terminal of the duplexer; and means for coupling the output terminal of the receiving filter and the receiving terminal of the duplexer;

wherein at least one of the filters is an LC-type dielectric filter which includes a multi-layer substrate which comprises a plurality of dielectric layers having resonators and at least one grounding layer disposed between the dielectric plates layers, the input and output terminals of the dielectric filter being disposed on the multi-layer substrate, the input being connected to one of the resonators and the output terminal being connected to another of the resonators, and a coupling circuit for coupling the resonators in the multi-layer substrate to one another, and wherein the means for coupling the input terminal of the transmitting filter and the transmitting terminal of the duplexer comprises an amplifier circuit for amplifying a transmitting signal which is supplied to the transmitting terminal of the duplexer, and a matching circuit for impedance matching between the amplifier circuit and an antenna connected to the antenna terminal of the duplexer, the amplifier and the impedance matching circuit being disposed on the multi-layer substrate of the dielectric filter.

35. The duplexer of claim 34, wherein both of the filters are LC-type dielectric filters, and wherein one of the filters is mounted on the other of the filters.

36. The duplexer of claim 35, wherein the multi-layer substrate of each of the filters has a top surface, a bottom surface, and a side surface connecting the top and bottom surface, and wherein each of the filters further comprises a metalized layer which covers a substantial portion of the top surface, a substantial portion of the side surface, and a substantial portion of the bottom surface, the at least one grounding layer being electrically connected to the metalized layer at the side surface.

37. The duplexer of claim 36, wherein the multi-layer substrate of each of the filters additionally has a plurality of further side surfaces connecting the top and bottom surfaces, and wherein the metalized layer of the respective filter additionally covers a substantial portion of at least two of the further side surfaces.

38. The duplexer of claim 36, wherein the top surface of the multi-layer substrate of each of the filters additionally has an uncovered portion which is not covered by the metalized layer, and wherein the coupling circuit for each of the filters comprises conductive patterns forming a plurality of printed circuit impedance elements on the uncovered portion of the top surface of the respective multi-layer substrate.

39. A duplexer having a receiving terminal, an antenna terminal, and a transmitting terminal, comprising:

a transmitting filter having an input terminal and an output terminal;

means for coupling the input terminal of the transmitting filter and the transmitting terminal of the duplexer;

means for coupling the output terminal of the transmitting filter and the antenna terminal of the duplexer;

a receiving filter having an input terminal and an output terminal;

means for coupling the input terminal of the receiving filter and the antenna terminal of the duplexer; and means for coupling the output terminal of the receiving filter and the receiving terminal of the duplexer;

wherein at least one of the filters is an LC-type dielectric filter which comprises a multi-layer substrate which includes a distributed parameter input resonator disposed on a first layer, a distributed parameter intermediate resonator disposed on a second layer, and a distributed parameter output resonator disposed on the first layer, the input resonator and the output resonator being positioned closely adjacent one another whereby an overcoupling between these resonators is obtained, and a grounding layer between the first and second layers, input means coupling the input resonator to the input terminal of the dielectric filter, output means coupling the output resonator to the output terminal of the dielectric filter; and coupling means for coupling the resonators to one another.

40. The duplexer of claim 39, wherein the multi-layer substrate has a top surface, a bottom surface, and a side surface connecting the top and bottom surfaces, and further comprising a metalized layer which covers a substantial portion of the top surface, a substantial portion of the side surface, and a substantial portion of the bottom surface, the grounding layer being electrically connected to the metalized layer at the side surface.

41. The duplexer of claim 40, wherein the multi-layer substrate additionally has a plurality of further side surfaces connecting the top and bottom surfaces, and wherein the metalized layer additionally covers a substantial portion of at least two of the further side surfaces.

42. The duplexer of claim 40, wherein the top surface additionally has an uncovered portion which is not covered by the metalized layer, and wherein the coupling means comprises conductive patterns forming a plurality of printed circuit impedance elements on the uncovered portion of the top surface.

* * * * *